United States Patent [19]

Giammarese

[11] Patent Number: 4,688,038

[45] Date of Patent: Aug. 18, 1987

[54] REMOTE METER-READER DEVICE FOR GAS METERS, AND THE LIKE

[75] Inventor: Victor Giammarese, Chicago, Ill.

[73] Assignees: Milton S. Gerstein; Marvin Benn, both of Chicago, Ill.

[21] Appl. No.: 781,670

[22] Filed: Sep. 30, 1985

[51] Int. Cl.[4] ..... G08S 23/00

[52] U.S. Cl. ..... 340/870.02; 324/157; 364/483; 346/33 R; 379/107

[58] Field of Search ..... 340/870.02, 870.06, 340/870.19, 870.09, 310 R, 310 A, 347 M, 347 P, 870.29; 250/231 SE; 324/103 R, 113, 114, 137, 157; 346/33 R, 14 MR; 364/483; 179/2 AM

[56] References Cited

U.S. PATENT DOCUMENTS

| | | | |
|---|---|---|---|
| 4,124,839 | 11/1978 | Cohen | 340/870.02 |
| 4,137,451 | 1/1979 | Einolf, Jr. | 340/870.29 |
| 4,204,115 | 5/1980 | Boldridge, Jr. | 340/870.02 |
| 4,327,362 | 4/1982 | Hoss | 340/870.02 |
| 4,350,980 | 9/1982 | Ward | 340/870.02 |
| 4,361,838 | 11/1982 | Mizuta | 340/870.02 |
| 4,374,384 | 2/1983 | Moates | 340/870.29 |
| 4,437,098 | 3/1984 | Rosinek et al. | 340/870.02 |
| 4,439,764 | 5/1984 | York et al. | 340/890.02 |
| 4,488,152 | 12/1984 | Arnason et al. | 340/870.02 |
| 4,500,870 | 2/1985 | Krohn et al. | 340/870.02 |
| 4,516,213 | 5/1985 | Gidden | 340/870.02 |

*Primary Examiner*—John W. Caldwell, Sr.
*Assistant Examiner*—Mahmoud Fatahi-Yar
*Attorney, Agent, or Firm*—Milton S. Gerstein; Marvin N. Benn

[57] ABSTRACT

A device for allowing the remote-reading of a utility meter having circular dials. The device includes an array of phototransistors for each circular dial of the utility meter. The face of the dial is illuminated selectively, when the reading of the dial is desired, by a light-emitting-diode at the center of the array of phototransistors. The phototransistor which is shaded by the pointer of the dial, which transistor indicates the highest value of the reading for thoses transistors shaded by the pointer, developes a signal indieative of that reading, which is outputted to a logic circuit for the development of the signal into a usable form for generating the value at a remote display device mounted on the outside of the building. Alternatively, the output from the logic circuit may be sent over a telephone transmission line to a remote computer-center for storage and retrieval, for billing customers.

4 Claims, 12 Drawing Figures

400

301
121
301

301
400

50
200

326
93
310
316
312
314
303
306
304
300

300
302

REMOTE METER-READER DEVICE FOR GAS METERS, AND THE LIKE

BACKGROUND OF THE INVENTION

The present invention is directed to a device for reading meters, such as gas meters, electric meters, and the like, at a distance remote from the actual physical position of the meter. Gas meters and electric meters are similar in that each has a plurality of circular dials for recording the usage of gas or electricity, respectively. Each dial represents a power of ten, so that in a gas meter, where there are four circular dials, the first dial indicates hundreds of cubic feet, the second dial indicates thousands of cubic feet, the third dial indicates tens of thousands of cubic feet, and the fourth dial indicates hundreds of thousands of cubic feet of gas used. Thus, for each complete revolution of the first dial, one thousand cubit feet of gas was consumed; for one complete revolution of the second dial, ten thousand cubic feet of gas was consumed; for one complete revolution of the third dial, one-hundred thousand cubic feet of gas was consumed; and for the fourth dial, one complete revolution thereof indicates one million cubic feet of gas consumed. For an electric meter, the principal is the same as above, only that the units measured are different.

Gas meters are usually placed in the basement of a house, apartment house, office building, and the like, and are usually not readily and easily accessible to a meter reader, which meter reader typically must make a special trip to the house, or the like, gain entrance to the basement or cellar, and then visually read each of the dials of the meter, and write such reading down for subsequent submittal to headquarters for eventual billing to the customer. This procedure of obtaining the correct meter-reading is usually not a smooth and simple task, since there are many stumbling blocks along the way to the proper and accurate carrying out of the reading. For example, a very common problem is the inability of the meter-reader to gain access to the basement to see the dials, since usually the basement is locked, and someone must be home in order to let him gain access to the basement. Further, the reader must know just where in the basement the meters are, for, if he does not know, he must waste time looking for them. Also, he must take the time to look at each and every dial of each and every meter, which is not a simple and easy task, since he must determine the value to which the pointer of each dial is pointing. There is currently available, and used, a remote-reading capability by some gas companies, which is accomplished by installing at the time of the first erection of a home or building, a special meter that allows for the reading thereof outside of the building proper, usually on an outside wall of the building. This special meter has a connection that outputs the reading of each dial to a device on the outside of the building, which may be read by a meter reader on the outside of the building. However, this device can only be used at first erection of the building, when it is first installed, or by replacing all of the old meters with these new ones, which is a costly, time-consuming, and, usually prohibitive project. Thus, the vast majority of all meters in place today are still the conventional dial-meters which require the on-site reading thereof in the basement of the home or house in which it is provided.

Since it is quite common for the meter-reader to be unable to gain access to the basement for reading the meter or meters, it is common practice for the gas company or electric company to estimate the current month's consumption by basing it upon past consumption. This estimate can be quite off, and can cost the consumer more each month, until such time as the reader can finally gain access to the basement and read the meter or meters, which may then allow for correction of the previous month's or months' estimated consumption. It is common, however, for a string of several months' readings to be estimated.

SUMMARY OF THE INVENTION

It is the primary objective of the present invention to provide a device allowing for the remote-reading of utility meters by retrofitting currently-available and currently-installed dial-meters, so that the readings of the dials of each meter may be outputted to a remote receiver for reading the meter thereby from a location outside of the building in which are mounted the meters.

It is another objective of the present invention to provide a remote-reading device for utility meters that will produce a string of binary digits indicative of the setting of each dial of the meter, which binary-digit output may be subsequently used to illuminate a display device mounted on an outside wall of the building, or be used for transmission via a modem to a remote, data-collecting center for direct storage onto a computer, for subsequent inclusion into the customer's records, for billing purposes.

It is another objective of the present invention to use a single display device on the outside of the building, the utility meters of which are to be read, such that each dial of a meter may be powered and read sequentially.

It is a further objective of the present invention to provide a remote, meter-reading device that is readily adaptable to currently-used, currently-available utility meters of the multi-dial type, such that it may easily, readily, and inexpensively be fitted on the glass enclosure of the meter in a fast and simple manner, to thus retrofit each meter for remote-reading capability.

It is still another objective of the present invention to provide a remote, meter-reading device for retrofitting existing and conventional, multi-dial utility meters such that entry into the interior of the house is obviated.

Toward these and other ends and objectives, the remote meter-reading device for utility meters includes a light emitting diode( LED) for each circular dial of the utility meter that provides a source of light that illuminates the face of the circular dial, which LED is selectively energized from a remote location on the outside of the building when reading of the utility meter is desired, so that a constant power source for the device of the present invention is obviated. Each circular dial-indicator of the utility meter is also provided with a plurality of photosensing transistors, one phototransistor for each position-indicator of the dial, such that, for the conventional dial having ten reference numeral position-indicators, there are provided ten phototransistors, one phototransistor juxtaposed over a respective position-indicator of the dial, so that when the pointer of the dial is positioned over a respective position-indicator, its respective phototransistor is reverse-biassed, owing to the cut-off of reflected light to that respective transistor because of the interposition of the pointer of the dial between the respective positionindicator and the respective phototransistor. Each set of phototransistors for each circular dial are connected in parallel, such that the phototransistors indicative of the numeral one , for example, are all connected in parallel for subsequent inputting into the logic circuit. Any set of phototransistors for its respective circular dial may be activated so that the respective dial's LED illuminates the face of the dial, to thus read that circular dial alone, with the other dials being off. The dials may, therefore, be read in sequence at the remote location on the outside of the building, with just one logic circuit being used for all of the plurality of sets of phototransistors. A power pack is used to individually activate each LED and its associated set of phototransistors, with the other LED's and respective sets of phototransistors being inactive. The logic circuit of the invention includes a plurality of logic gates that, firstly, ensure that when one phototransistor has been reverse-biassed, due to the pointer of the dial being interposed between it and the position-indicator with which it associated, the phototransistor immediately preceding it and indicative of a lower value is forward biassed, so that only the numeral indicative of the one phototransistor is detected and indicated on the display device at the remote location.

In the preferred form of the invention, the display device at a remote location is an L.E.D. display, with a decoder/driver. Alternatively, the binary value from the logic circuit may be transmitted by a modem and over a telephone line to a remote computer center for storage of the bit stream and the decoding thereof, by account number and customer.

BRIEF DESCRIPTION OF THE DRAWING

The invention will be more readily understood with reference to the accompanying drawing, wherein.

DETAILED DESCRIPTION OF THE INVENTION

Figure 1A:
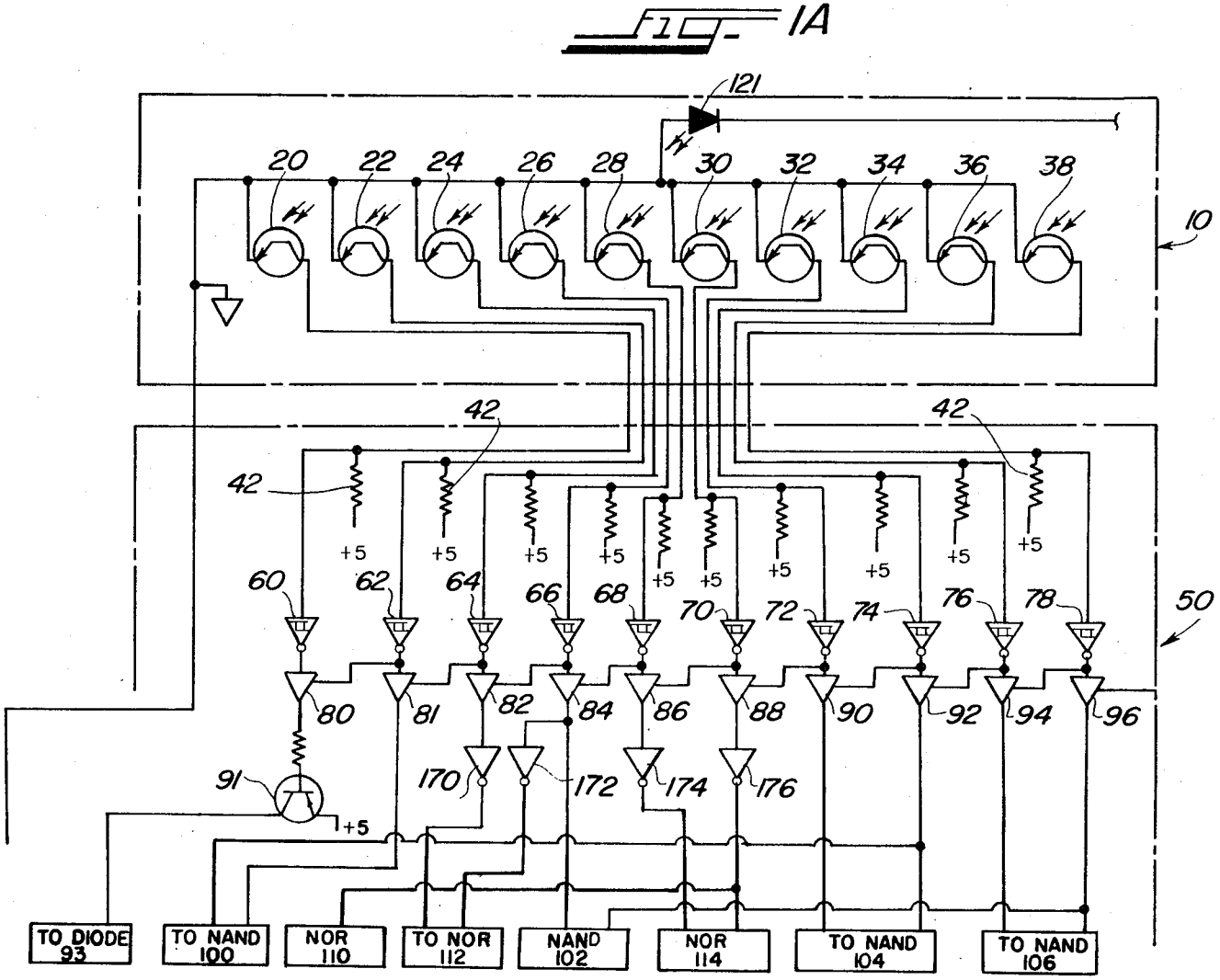
FIG. 1A is an electrical schematic showing one array of phototransistors of the present invention for one circular dial of an utility meter, with each phototransistor of the array being coupled to Schmitt trigger inverter and buffer.
Figure 1B:
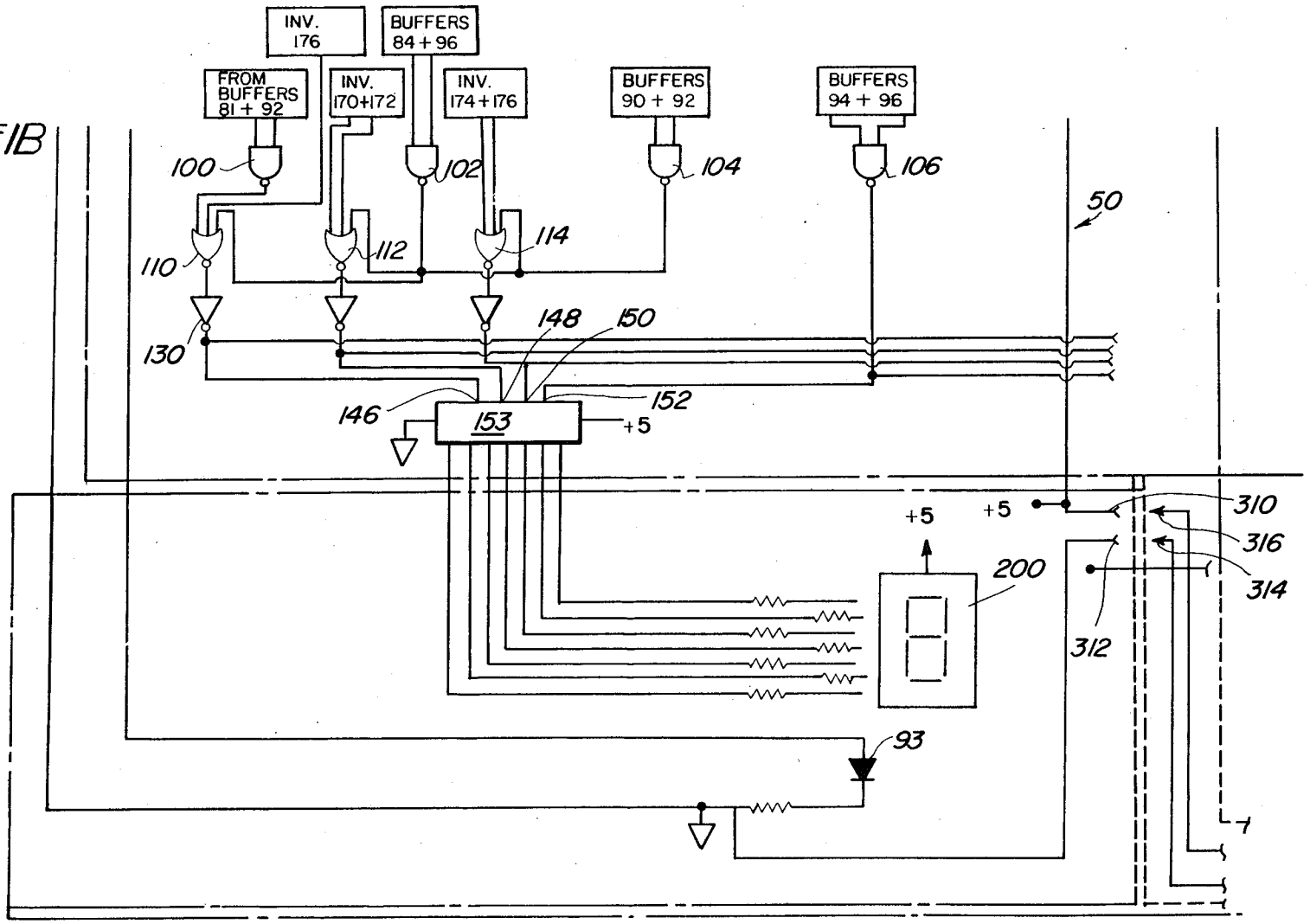
FIG. 1B is an electrical schematic showing the coupling of the Schmitt triggers and buffers of FIG. 1 to the logic gates of the logic circuit of the present invention.

Referring now to the drawing in greater detail, the remote, utility meter-reading device of the present invention is indicated generally by reference numeral 10, and is shown schematically in FIGS. 1A and 1B. The schematic shown in FIGS. 1A and 1B is for one circular dial of the meter, it being understood that the other three circular dials are to have the exact same photosensor array as that shown in FIG. 1A. In the preferred form of the invention, there are provided ten phototransistors 20–38, one transistor being juxtaposed over one of the position indicators of the circular dial with which it is associated. It is, of course, to be understood that more than ten such phototransistors may be used, such that, for example, twenty may be used so that indications of 0.5 may be shown. That is, when ten phototransistors are used, each represents onetenth of a revolution of the pointer as compared to the phototransistors directly adjacent to it. When twenty such phototransistors are used, each indicates one twentieth of a revolution of the pointer of the dial. The phototransistors themselves are placed outside the glass enclosure of the meter directly opposite the respective circular dial with which it associated. The array of transistors for the four dials are held firmly to the glass by any conventional selfstick type of means. Thus, in the preferred form of the invention, there are provided four sets of ten phototransistors, or a total of forty phototransistors in all. The phototransistor 20 represents a zero, the phototransistor 22 represents a one, the phototransistor 24 represents a two, and so until phototransistor 38 which represents a nine of the respective circular dial. These ten phototransistors are arranged circularly, with the radius of the circle being such that, for any location of the pointer of the dial, at least one phototransistor is always shaded thereby. At the center of such circle there is provided a light emitting diode (LED) 121 (FIG. 2B) serving as a light-source by which the face of the circular dial may be lit up to thus reflect the light back toward the ten photosensors. Each phototransistor 20–38 is forward biassed when reflected light impinges thereon, but is reverse-biassed when there is a lack of such light. Therefore, when the LED 71 is activated and provides a source-beam of light to the circular dial to be read, all but that phototransistor directly juxtaposed over the position indicator to which the pointer of the dial points will be forward biassed. The other phototransistor will be reverse-biassed since the pointer of the dial intervenes between it and the face of the dial, to thus cut off the reflected light to that phototransistor. For example, assuming that the pointer of the respective dial is over the number one thereof, when the LED for that dial is activated by the remote power pack to be described below, the reflected light to the phototransistor 22 is cut off by the interposition of the pointer of that dial. Thus, phototransistor 22 is reverse-biassed, while the remainder of the phototransistors are all forward-biassed. This fact may be used by the logic circuit shown in FIGS. 1A and 1B to develop an unique output to a remote LED display device for indicating the numeral one. Thus, in this example, the reverse-biassed phototransistor 22 has its collector go high, while all of the other collectors of the other phototransistors are all low. This higher voltage of the phototransistor 22, which is kept high by pull-up resistor 42, is inputted into a 7414 Schmitt-trigger inverter 62, the output of which is low.

The low output voltge is then inputted into a 74126 high enable buffer, the low output of which goes into a NAND gate 100 (FIG. 1B), causing the input of NOR gate 110 to go high, which in turn causes the input to an inverter 130 to go low. The output of this inverter 130 is coupled to the "units", $2^0$ input (input 146) of a 7447 decoder/driver 150. This causes the number one digit to be displayed on a remote L.E.D. display device 200 coupled to the output of the decoder/driver 150. A similar process takes place for the phototransistors 24, 28 and 36, which represent, respectively, the digits 2, 4 and 8. That is, each of the phototransistors 24, 28 and 36 are directly coupled to the inputs 148,150 and 152, respectively, by Schmitt-trigger inverters 64, 68 and 76, respectively, and by buffers 82, 86 and 94, respectively. Since these four phototransistors represent the four binary inputs 146 148,150 and 152 of the decoder/driver 150, all that is required for these four digits is that the respective inputs therefor go high. For the other phototransistors representing the digits three, five, six, seven, and nine (excluding zero for the moment, which will be discussed below), a combination of the inputs 146,148, 150, and 152 are required in order to output that number on the remote display device. Thus, additional logic elements are required to accomodate these digits. The digit three is simply the addition of two and one. Therefore, in order to get a reading of three, when the phototransistor 26 is reversed-biassed (when the pointer of the dial points to or is near the digit three) the output from the NAND gate 102 must be inputted into both NOR gates 110 and 112, so that the inputs 146 and 148 both go high, to thus cause a reading of the digit three at the remote display. For the digit five, which is simply the addition of four and one, the output from the buffer 88 is inputted to an inverter 176 to cause the input to each of the NOR gates 110 and 114 to go high, to thus affect the inputs 146 and 150 to go high, to thus cause a showing of the digit five at the remote L.E.D. display. For the digit six, which is the summation of four and two, the NAND gate 104 is coupled to the inputs of both the NOR gates 112 and 114, representing the $2^1$ and $2^2$ inputs of the decoder/driver 150 (inputs 148 and 150). For the digit seven, which is the summation of one,two-,and four, the buffer 74 output is coupled to the input of NOR gates 110, 112, and 114, with the NAND gate 104 being used for both the digit six and seven, since both must be coupled to the NOR gates 112 and 114. For the digit nine, which is the summation of eight and one, the output from the buffer 96 is inputted to the NAND gate 106 and to the NAND gate 102, the output from which NAND gate 102 is inputted into the NOR gate 110 for the units place of the encoder/driver (input 146). Thus it can be seen that any digital reading not a power of two on the dial of the meter, may be readily read out via encoder/driver 150, by combining the appropriate basic digits of 1,2, 4, and 8.

Figures 1C, 2A, 2B, 2C, 2D, 2E:
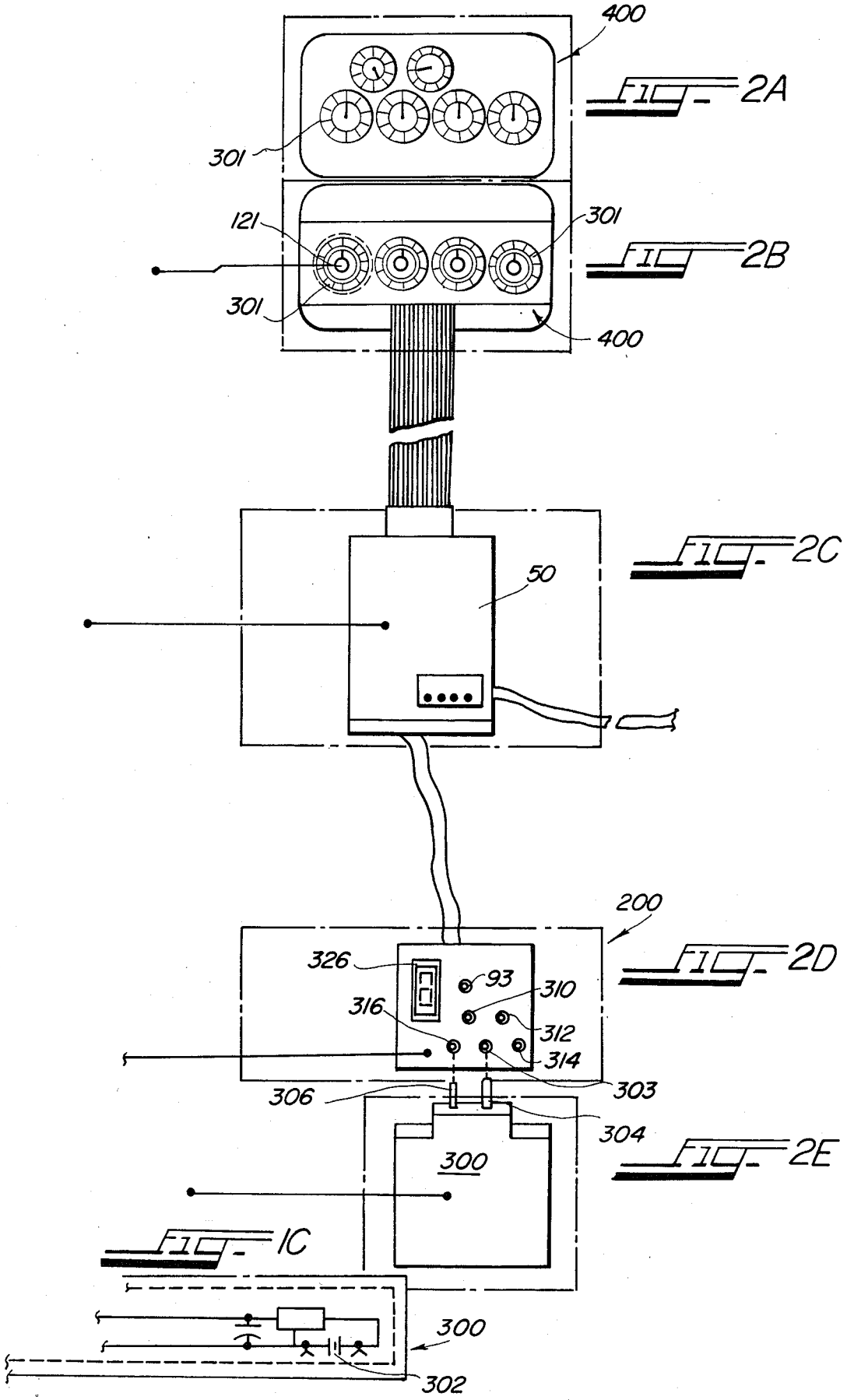
FIGS. 1C is an electrical schematic showing the power pack selector of the remote-reading device of the present invention, which power pack is used to select one of the arrays of phototransistors shown in FIG. 1A.
FIGS. 2A through 2E are representations of the different portions of the remote meter-reading device of the present invention, showing the system-wide coupling therebetween.

It is important, when one phototransistor is reverse-biassed to indicate a digit to be displayed at the remote display device, that the previous phototransistor not be allowed to display a digit thereof. For example, when the pointer of the circular dial, such as dial 301 in FIG. 2A, is approaching the two-digit position indicator and finally is pointed directly thereto, it must be ensured that number one digit's output is inhibited, so that only one transistor is indicative of the reading of that dial. To accomplish this, each Schmitt-trigger inverter 60–78 has its output coupled to a respective, previous buffer 80–96. Thus, for the Schmitt-trigger inverter 64 for the digit two, its output is coupled to the buffer 81 in order to disable the output thereof, thus inhibiting a number one from being displayed. Thus, the buffers 80–96 allow for the inhibiting of any number to be displayed other than the number associated with the highest phototransistor whose collector output is high. Each buffer output is disabled only when there is a low output from the Schmitt-trigger inverter associated with the phototransistor next-in-sequence. Thus, when the pointer of the dial overlaps two adjacent phototransistors, only that phototransistor representing the higher value of reading is allowed to input its signal-voltage for subsequent development of the signal by the logic circuit. For the digit zero, phototransistor 20 is indicative of this value, and is indicated on the remote display unit 200 via the Schmitt-trigger inverter 60, buffer 80, transistor switch 91, which is coupled to the remote display unit directly without first being coupled to the decoder/driver 153. Thus, when the pointer is at the zero position-indicator of the dial, the transistor switch 91 is activated to indicate a "valid" zero on the display unit, via diode 93. However, this "valid" zero also serves the function of ensuring that any zero that is indicated on the display unit is a valid zero, in that the true reading of the circular dial of the meter is, in fact, zero. For example, when the pointer of the dial points to a positionindicator for the digits between 1 and 9, ordinarily that respective digit would be displayed on the remote display unit. However, if that phototransistor were or became defective, it might still conduct, thus producing a low collector output, thereby causing a zero to be indicated, by default, on the remote display unit 200, which would cause an erroneous reading thereof. Thus, to protect against this, a valid zero—that is, when the pointer of the dial is, in fact, pointing to the zero position-indicator—is only ensured to be a zero if the diode 93 is illuminated via the transistor switch 91. That is, if the display unit shows a zero because of the defect in the phototransistor that should have had its collector output go high, there would be no "valid" zero indicator light, even though the display unit will show a zero, thus informing the technician or reader of the display unit that the unit is defective for at least one of the phototransistors thereof. Thus, a zero on the remote display unit is a true or valid zero only when accompanied by the valid zero indicator light 93.

FIG. 1A shows just one array of phototransistors 20–38. If the meter being read has four circular dials, then four such arrays 10 are provided, one for each dial. However, only one logic circuit 50 is provided, with each sensor array 10 being coupled to the logic circuit 50. This is accomplished by connecting the four phototransistors 20 in parallel, by connecting the four phototransistors 22 in parallel, by connecting the four phototransistors 24 in parallel, and so on for the remainder of the phototransistors 26–38. Thus, only one logic circuit 50 is required for the plurality of sensor arrays 10, since only one L.E.D. is activated at a time, and only one dial face. Thus, those phototransistors belonging to the arrays whose dial face is not illuminated are not conducting at all, thus having no effect on the phototransistors that are conducting from the array whose dial face is illuminated. It is, of course, within the realm and scope of the present invention to provide a remote-reading device for utility meters in which each sensor array 10 is provided with its own logic circuit 50, so that the there would be provided a plurality of display units 200, one for each logic curcuit 50. This has the advantage of being able to read the entire meter at one time, at once glance, since the reading of each dial will have been indicated on its own remote display unit 200 at the same time.

Each L.E.D. 121 of a sensor array 10 is selectively illumined by a remote power pack 300 shown schematically in FIG. 1C, which has its own D.C. power source 302. As shown in FIG. 2E, this power pack 300 is connectable to the remote display unit 200 shown in FIG. 2D by connectors 304 and 306, with connector 304 plugging into outlet 303 of the display unit, and the connector 306 plugging into to a chosen one of the four outlets 310,312,314, or 316, for energizing the circuit and one of the L.E.D.'s of one of four sensor arrays. The one array chosen is activated by a simple completion of the circuit, as shown in FIG. 1B. The L.E.D. display 326 of the display unit actually lights up the digits indicative of the pointer of that dial illumined.

FIGS. 2B–2E show the interconnection of the meter 400 with four dials 301 thereof. The logic circuit 50 is shown in FIG. 2C interconnected between the sensor arrays 10 mounted over the four dials 301 and the display unit 200.

Figure 5:
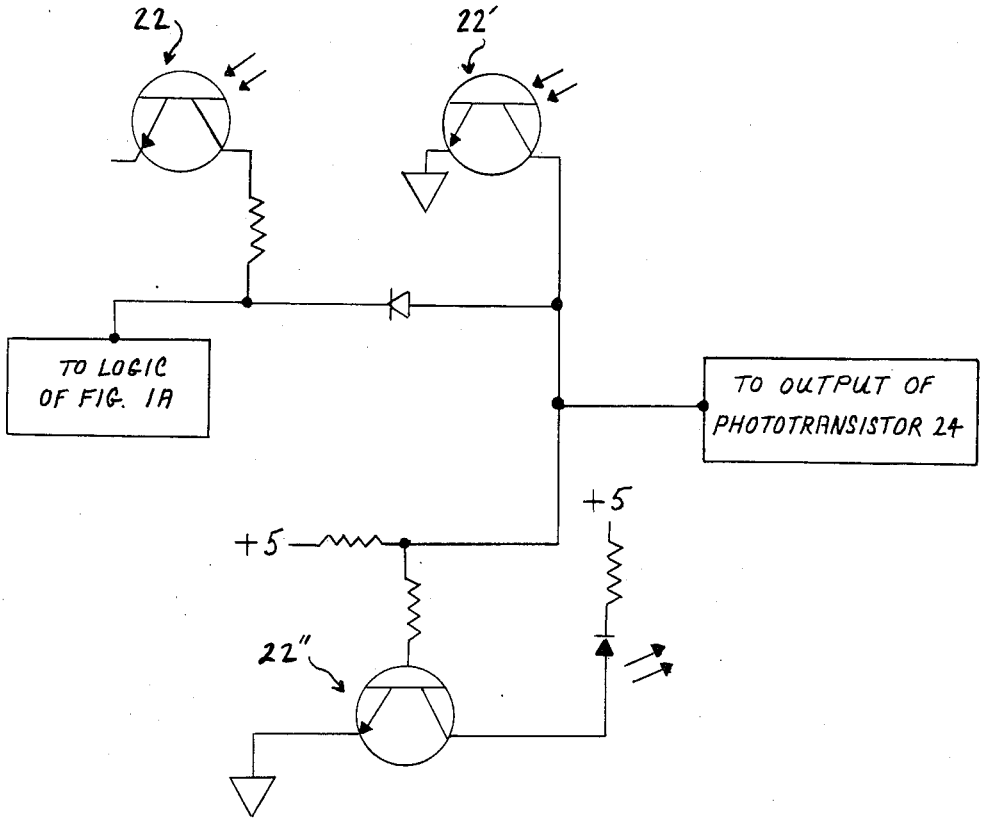
FIG. 5 is an electrical schematic showing the connection of each one-half-digit phototransistor in the modification of the present invention when twenty phototransistors are used for reading a circular dial of a utility meter.

While there have been shown ten phototransistors for each array 10, any multiple of ten may used for each array. Thus, for example twenty such transistors may be used, with each being indicative of one-twentieth of a revolution of the dial-pointer. The manner by which digits not of the power of two would be developed would be exactly as that above-described for the case of ten transistors per sensor array 10. The only difference would be that the L.E.D. display unit for showing the readings would be a conventional one having besides the whole number, also a decimal number for showing the position of the pointer of the dial mid-way between two whole numbers. The circuitry of FIGS. 1A–1C would still be the same in this modification, with the additions of other components for the half-indicator phototransistors. FIG. 5 shows this additional circuitry for one of the half-indicators 22' constituting the 1.5 meter reading, where the phototransistor 22 constitutes the digit one reading. The output of this 1.5 phototransistor is coupled to the output of the 1-digit phototransistor 22, so that, when this 1.5 phototransistor goes high, when the pointer is positioned thereat, the output of the phototransistor 22 also goes high, and is acted upon in the same manner as described above in the case of a total of ten phototransistors. The output of the phototransistor 22' is also coupled to driver-transister 22'', which drives the 0.5 indicator of the L.E.D. display device in the conventional manner. To ensure that the phototransistor 22 is disabled when the next phototransistor 24 goes high, the output of the next-in-the-series phototransistor 24 is coupled to the output of the phototransistor 22', so that, when the phototransistor 24 goes high, the 1.5 driver-transistor 22'' is cut-off. The remaining nine 0.5 phototransistors are similarly connected.

Figures 3A, 3B:
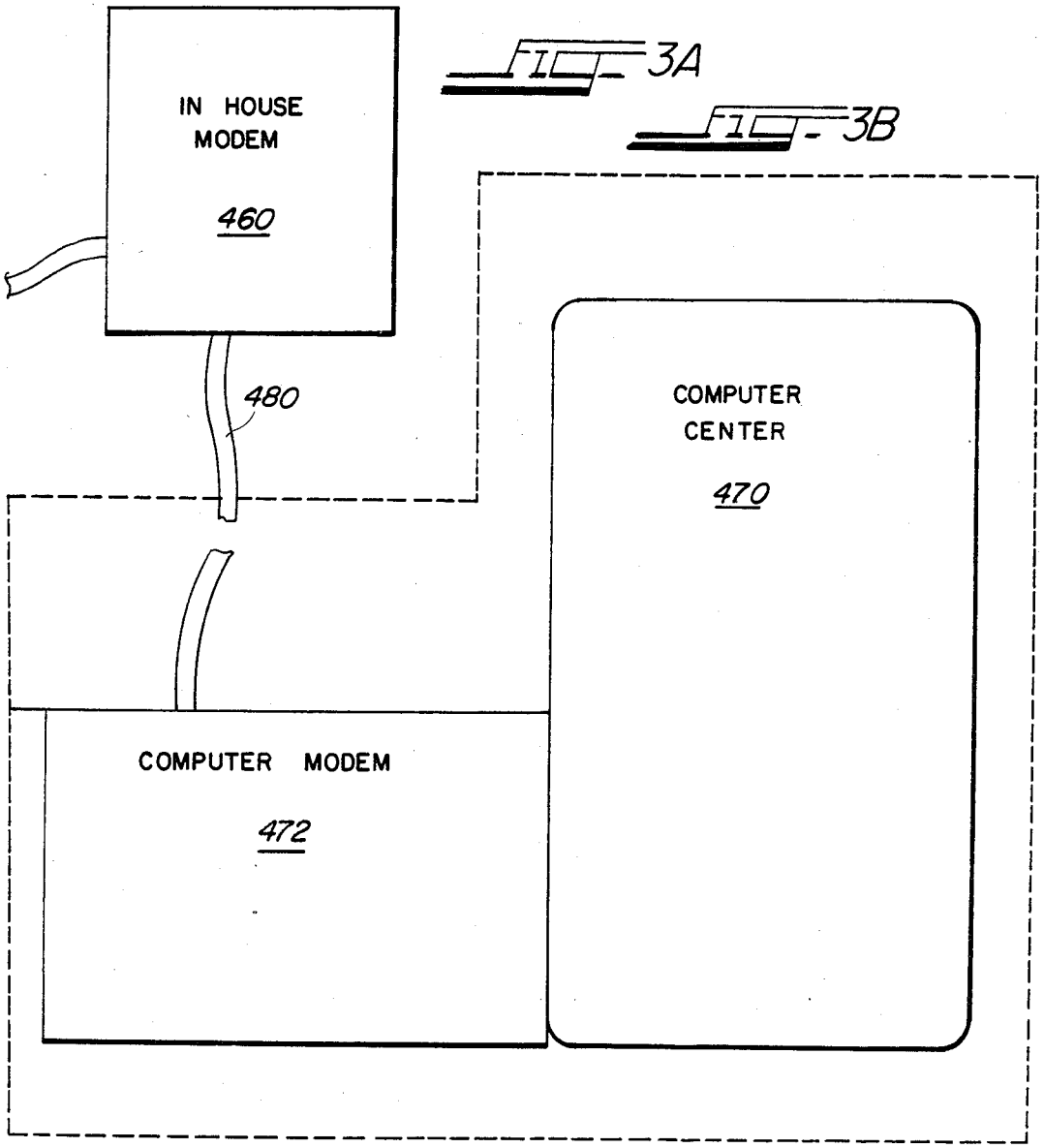
FIGS. 3A and 3B are representations of the modem transmission system of the present invention in combination with a data storage center for storing the data stream from the remote meter-reading device of the present invention.

In a modification of the present invention, instead of outputting the read-out to a remote L.E.D. display unit 200, the binary value going to the 7447 decoder/driver 153 may be transmitted via a modem over a transmission line, such as a telephone cable, to a remote computer processing center, where the bit stream may be stored on disc and decoded for subsequent storage by account number, for eventual billing to the customer. FIGS. 3A and 3B show this modification, where a conventional modem 460 is coupled to the telephone line of the customer, as, for example, in the basement of the house of the customer, and transmitted to the computer center 470 for processing. The receiving-computer would, of course, have its own modem 472 coupled to the in-house modem 460 via transmission line 480, all in the conventional manner.

Figure 4:
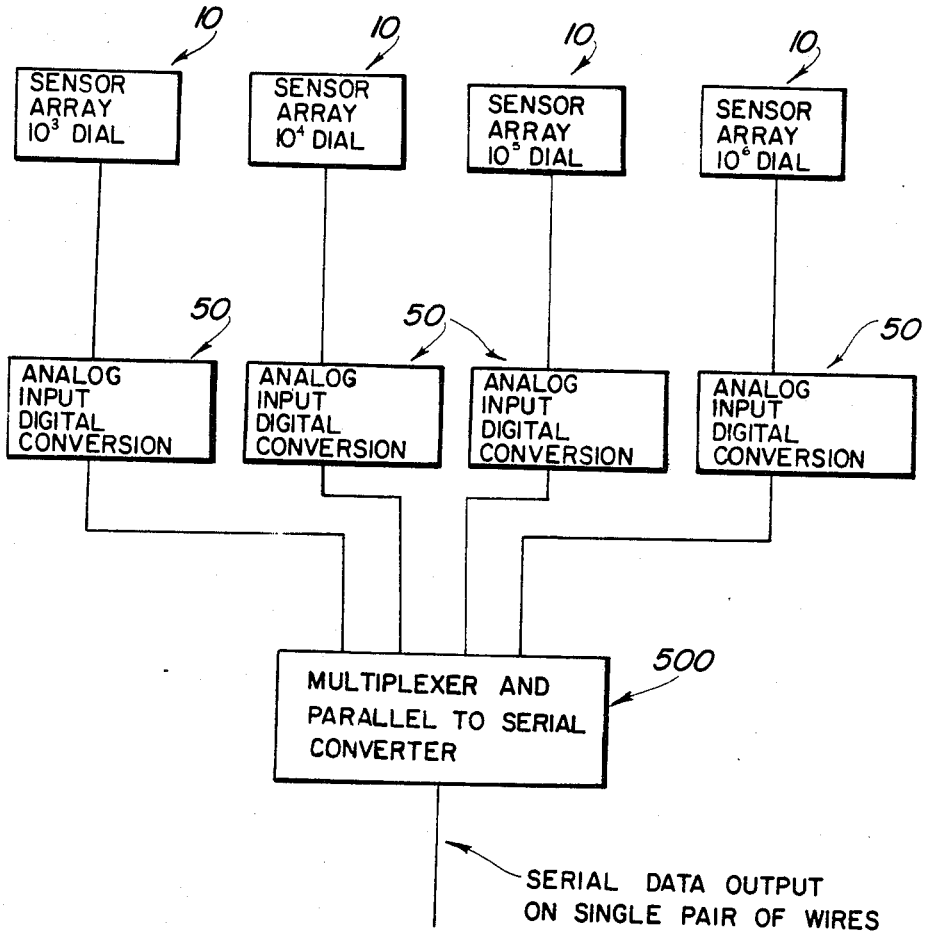
FIG. 4 is a block diagram showing the manner by which transmission of the data stream from each of the arrays of phototransistors is achieved, so that parallel-toserial conversion for transmission via a modem may be achieved.

FIG. 4 is a block diagram showing the manner by which the binary value to the 7447 decoder/driver 153 is multiplexed in order to convert the parallel bit value to serial, which multiplexer 500 is conventional and well-known in the art.

While a specific embodiment of the invention has been shown and described, it is to be understood that numerous changes and modifications thereof may be made without departing from the scope and spirit of the invention as set out in the appended claims. For example, instead of using light as the analogue-producing portion of the present invention, magnetic signals may be used instead.

What is claimed is:

1. A method of remotely-reading a utility meter having at least one dial having a pointer thereof for indicating the reading of the respective dial, comprising;

retrofitting the dial for remote-reading by placing an array of a plurality of photosensing components in close proximity to the face of the respective dial to be read from a remote site, such that the array of photosensing components senses the position of the pointer at various locations of its angular movement about the dial face;

illuminating the face of the respective dial when it is desired to read the position of the pointer thereof, such that the light from the face of the dial is sent to the array of photosensing components in order for the array of photosensing components to sense the reading of the pointer;

sending a signal in response to said step of illuminating indicative of the reading of the pointer of the respective dial to a digital formation means; and developing the signal from the array of photosensing components in the digital formation means to produce an output into a remote reading device, whereby the remote reading device may indicate the reading of the respective dial.

2. The method according to claim 1, wherein said step of developing the signal from the array comprises disabling an output signal from one of the plurality of photosensing components directly in front of the other photosensing component that has not received light from the face of the respective dial via said step of illuminating, said one photosensing component being indicative of the next lowest value as compared with said other photosensing component.

3. The method according to claim 1, wherein said step of placing a circular array of photosensing components comprises arranging a photosensing component at every one-twentieth revolution of the respective pointer.

4. The method according to claim 1, wherein said step of illuminating the face of the dial comprises powering a light source at a time when a reading of the dial is desired, and de-energizing the light source when it is not time to read the dial.

* * * * *